US005156759A

United States Patent [19]

Culpon, Jr.

[11] Patent Number: 5,156,759

[45] Date of Patent: Oct. 20, 1992

[54] HIGH TEMPERATURE COMPRESSOR OIL

[75] Inventor: Douglas H. Culpon, Jr., Port Neches, Tex.

[73] Assignee: Texaco Inc., White Plains, N.Y.

[21] Appl. No.: 698,869

[22] Filed: May 13, 1991

[51] Int. Cl.[5] ..... C10M 129/72; C10M 133/44

[52] U.S. Cl. ..... 252/56 R; 252/50; 252/52 R; 252/56 D; 252/394; 252/396; 252/404; 252/405; 585/13; 585/18

[58] Field of Search ..... 252/56 R, 56 S, 56 D, 252/51.5 R, 52 R, 50, 396, 405, 404, 389.53, 394; 585/13, 18

[56] References Cited

U.S. PATENT DOCUMENTS

| | | | |
|---|---|---|---|
| 2,638,449 | 5/1953 | White et al. | 252/515 |
| 3,347,791 | 10/1967 | Thompson et al. | 252/56 S |
| 3,697,427 | 10/1972 | Byford et al. | 252/34 |
| 4,218,330 | 8/1980 | Shubkin | 252/46.6 |
| 4,320,020 | 3/1982 | Lange | 252/51.5 R |

*Primary Examiner*—Margaret Medley

*Attorney, Agent, or Firm*—Jack H. Park; Kenneth R. Priem; Richard A. Morgan

[57] ABSTRACT

A lubricating composition has been found which has particular utility in gas compressors. The composition comprises a polyalphaolefin base oil, an ester oil solubilizer, antioxidants and metal passivators. The composition replaces a mineral oil formulation and demonstrates comparable thermal and oxidative stability in the absence of sulfur, phosphorous and metal additives.

4 Claims, No Drawings

HIGH TEMPERATURE COMPRESSOR OIL

FIELD OF THE INVENTION

The invention relates to a synthetic lubricating oil composition. The invention also relates to lubricating oil comprising antioxidants and rust inhibitors. The invention particularly relates to lubricating oils which are free of sulfur, phosphorous and metals.

DESCRIPTION OF OTHER RELATED METHODS IN THE FIELD

Lubricating oils are characterized by resistance to oxidation and corrosion inhibition. Typical compressor lubricants include amino, phenolic and other antioxidants. Amino and phenolic antioxidants contain no sulfur and phosphorous, while dithiocarbamates, zinc dialkyldithiophosphates and many other antioxidants contain sulphur, phosphorous and metals such as zinc. Phosphates, phosphites and essentially all extreme pressure and antiwear additives contain sulfur and/or phosphorous. A variety of components may be used to provide rust protection, corrosion protection and metal passivation. Since lubricating oils used in gas compressors, such as in the manufacture of ethylene oxide and propylene oxide are subject to unique conditions of operation, special attention must be directed to the problems encountered by the inevitable contacting of process streams with these lubricating oils. The effect these lubricating oils have on the process will be determined by the formulation which will contain anti-wear additives, oxidation inhibitors, demulsifying agents, rust-inhibitors, etc.

In particular, it has been found that conventional rust-inhibited and oxidation stabilized compressor lubricants are unsuitable in the manufacture of ethylene oxide and propylene oxide. Conventional lubricants contain sulfur, phosphorous and metal salt additives to improve their operating properties. The smallest amounts of these additives finding their way into the process have been found to poison oxidation catalysts, shortening the run length.

There is a need in the art for a compressor lubricant which is rust-inhibited and oxidation stable and provides good lubricity at high temperatures in the absence of sulfur, phosphorous and metals such as zinc.

SUMMARY OF THE INVENTION

The invention is a lubricating oil composition comprising a major proportion of a synthetic base lubricating oil. Incorporated in minor proportion are an additive solubilizer, an antioxidant and a rust inhibitor/-metal passivator.

The additive solubilizer is an ester synthetic lubricating oil incorporated in an additive solubilizing amount of at least 5 wt %. The antioxidant comprises 0.1 to 3 wt % of phenolic and/or amino antioxidants. The rust inhibitor/metal passivator comprises 0.01 to 0.5 wt % of triazole and/or alkenyl succinic acid rust inhibitors.

The lubricating oil composition is characterized as free of sulfur, phosphorous and metals. This is particularly beneficial in the use of the oil to lubricate gas compressors used in the manufacture of chemicals.

DESCRIPTION OF THE PREFERRED EMBODIMENTS

Compressor lubricants must protect rotating bearing and/or sliding screws, pistons, crankcase components and other parts. Depending on the compressor design and type, high temperatures may be generated from adiabatic compression or friction of moving parts. Adequate thermal and oxidative stability is therefore a requirement for compressor lubricants. Rust and oxidation inhibited lubricants also provide rust protection, corrosion protection and metal passivation. Antiwear protection is sometimes needed.

Typical base fluids for compressor lubricants include mineral oils and a variety of synthetic base fluids. Mineral oil products are cost effective for applications where excellent high temperature stability is not required. Mineral oils may be processed to reduce sulfur content but generally will contain residual sulfur in amounts of 0.1 to 0.5 wt %. For this reason, synthetic base lubricating oils are used in the instant composition because they are free of residual sulfur. Synthetic base lubricating oils may include polyalphaolefin (PAO) oils, ester (diester and polyolester) oils, polyalkylene glycol oils or mixtures having a kinematic viscosity of 2 cSt to 10 cSt at 100° C. These synthetic base oils are inherently free of sulfur, phosphorus and metals.

Polyalphaolefin oils are prepared by the oligomerization of 1-decene or other lower olefin to produce high viscosity index lubricant range hydrocarbons in the $C_{20}$ to $C_{60}$ range. Other lower olefin polymers include polypropylene, polybutylenes, propylene-butylene copolymers, chlorinated polybutylenes, poly(1-hexenes), poly(1-octenes), alkylbenzenes (e.g., dodecylbenzenes, tetradecylbenzenes, dinonylbenzenes, di(2-ethylhexyl)-benzenes); polyphenyls (e.g., biphenyls, terphenyls, alkylated polyphenols); and alkylated diphenyl ethers and the derivatives, analogs and homologs thereof.

Polyalkyleneglycol oils are prepared by polymerization of alkylene oxide polymers and interpolymers and derivatives wherein the terminal hydroxyl groups have been modified by esterification, etherification, etc. Examples include polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

The ester oil serves as the solubilizing medium between the synthetic lubricating base oil and the additive composition. Ester oil may comprise an aliphatic diester of an aliphatic dicarboxylic acid. These include esters of phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting 1 mole of sebacic acid with two moles of tetraethylene glycol and 2 moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

The additive composition comprises an antioxidant comprising a phenolic antioxidant, an amino antioxidant and mixtures thereof.

Phenols which are useful for this purpose include various alkylated phenols, hindered phenols and phenol derivatives such as t-butyl hydroquinone, butylated hydroxyanisole, polybutylated bisphenol A, butylated hydroxy toluene, alkylated hydroquinone, 2,5-ditert-aryl hydroquinone 2,6-ditert-butyl-para-cresol, 2,2'-methylenebis(6-tert-butyl-p-cresol); 1,5-naphthalenediol; 4,4'-thiobis(t-tert-butyl-m-cresol); p,p-biphenol; butylated hydroxy toluene; 4,4'-butylidenebis(6-tert-butyl-m-cresol); 4-methoxy-2,6-ditert-butyl phenol; and the like.

Amino antioxidants include aldehyde amines, ketone amines, ketone-diarylamines, alkylated diphenylamines, phenylenediamines and the phenolic amines.

The additive composition comprises a rust inhibitor/-metal passivator. These are selected from triazole derivatives and alkenyl succinic acid esters which are known for this purpose.

Triazole derivatives may be the reaction product of a substantially aliphatic, substantially saturated hydrocarbon substituted carboxylic acid wherein the hydrocarbon group contains at least about 20 aliphatic carbons, with an aminoguanidine derivative of the formula:

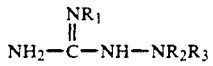

wherein $R_1$ is hydrogen or a $C_1$ to $C_{15}$ hydrocarbyl radical, and $R_2$ and $R_3$ are independently hydrogen or a $C_1$ to $C_{20}$ hydrocarbyl radical, or salts thereof. Reaction is with reactants and under conditions to form a hydrocarbon substituted 1,2,4-triazole, preferably the 1,2,4-triazole-3-amine.

Suitable triazoles also include tolyltriazole, benzotriazole and aminotriazole.

The alkenyl succinic acid or anhydride structural unit employable in the instant invention is represented by the formula:

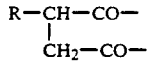

in which R is an alkenyl group having from 10 to 35 carbon atoms. Preferably R is an alkenyl group having 14 to 20 carbon atoms. Examples of suitable alkenyl groups include decenyl, dodecenyl, tetradecenyl, octadecenyl and tricosenyl. For the purposes of this invention the alkenyl succinic acid and the alkenyl succinic anhydride function as reaction equivalents, that is, the same products are formed with either the acid or anhydride reactant.

Either one or both of the carboxyl functionalities is esterified, preferably with an amino alcohol represented by the formula:

$$H_2N(CH_2)_nOH$$

in which n is an integer from 2 to 6. Preferably n is an integer from 2 to 5 and more preferably an integer from 2 to 3. Examples of suitable alkanolamine reactants are monoethanolamine, 1,2-propanolamine, 1,3-propanolamine, 1,2-butanolamine, 1,3-butanolamine and 1,4-butanolamine.

Examples of succinamic acid products are
N-(2-hydroxyethyl)-n-tetradecenyl succinamic acid,
N-(3-hydroxypropyl)-n-tetradecenyl succinamic acid,
N-(2-hydroxypropyl)-n-tetradecenyl succinamic acid,
N-(4-hydroxybutyl)-n-dodecenyl succinamic acid,
N-(3-hydroxybutyl)-n-octadecenyl succinamic acid,
N-(2-hydroxybutyl)-n-dodecenyl succinamic acid,
N-(2-hydroxyethyl)-n-decenyl succinamic acid, and
N-(2-hydroxyethyl)-n-octadecenyl succinamic acid.

Examples of the succinimide products are
N-(2-hydroxyethyl)-n-tetradecenyl succinimide,
N-(2-hydroxypropyl)-n-tetradecenyl succinimide,
N-(3-hydroxypropyl)-n-tetradecenyl succinimide,
N-(4-hydroxybutyl)-n-dodecenyl succinimide,
N-(2-hydroxybutyl)-n-octadecenyl succinimide,
N-(2-hydroxyethyl)-n-octadecenyl succinimide, and
N-(2-hydroxyalkyl)-n-tricosenyl succinimide.

Examples of succinamide products are
N,N'-di(2-hydroxyethyl)-n-tetradecenyl succinamide,
N,N'-di(2-hydroxypropyl)-n-tetradecenyl succinamide,
N,N'-di(2-hydroxypropyl)-n-tetradecenyl succinamide,
N,N'-(3-hydroxypropyl)-n-tetradecenyl succinamide,
N,N'-di(4-hydroxybutyl)-n-dodecenyl succinamide, and
N,N'-di(2-hydroxybutyl)-n-octadecenyl succinamide.

The alkenyl succinic acid (anhydride) and alkanolamine reaction products are described in U.S. Pat. No. 4,505,832 to Whiteman et al. incorporated herein by reference.

The lubricating compositions are formulated by methods well-known in the art. That is, the formulation is carried out continuously at the cannery. In the alternative, the compositions can be formulated in a semi works by hand. The additive composition substituents are weighed individually on a scale and added to an amount of ester oil in a steam jacketed stainless steel kettle at ambient temperature to 120° F., with stirring. When a homogeneous mixture is achieved, the base lubricating is added gradually, with continuous stirring. The result is the final lubricating oil composition. This composition is canned and shipped to point of use. At the point of use, the crankcase of a gas compressor is drained and then refilled with the lubricating oil composition of the invention.

This invention is shown by way of example.

Four lubricating oils were formulated according to the invention to replace a commercial mineral oil. The compositions and test results follow:

| | Weight | |
|---|---|---|
| Formulation | 1 | 2 |
| Regal R&O 68 (mineral oil) | | 100 |
| 6 cSt PAO | 37.95 | |
| 8 cSt PAO | 40.95 | |
| TMP Ester w. $C_8$–$C_{10}$ acids | 20.0 | |
| Phenolic antioxidant | 0.5 | |
| Octylbutylphenylamine antioxidant | 0.5 | |
| Alkenyl succinic acid half ester | 0.05 | |
| Triazole derivative | 0.05 | |
| Test | Test Results | |
| Viscosity, cSt @ 40° C. | 31.9 | 34.21 |
| Viscosity, cSt @ 100° C. | 5.98 | 5.73 |
| Viscosity Index | 135 | 107 |
| Rotary Bomb Oxidation Test, Min. | 600+ | 600+ |
| PDSC Temp. Prog., Ext. Onset, °C. | 227 | 236 |
| PDSC Isothermal, 180° C., EO, Min. | 20 | 14 |

-continued

| | | | |
|---|---|---|---|
| SSW Rust Test | Pass | Pass | |
| Copper Strip Corrosion | 1A | 1B | |
| 4-Ball Wear, mm | 0.48 | 0.53 | |
| Wear Index | 18 | 15 | |
| Weld Point, kg | 126 | 126 | |
| Formulation | 3 | 4 | 5 |
| 6 cSt PAO | 37.9 | 34.0 | 37.4 |
| 8 cSt PAO | 40.9 | 59.8 | 40.4 |
| TMP Ester w. $C_8$-$C_{10}$ acids | 20.0 | — | 20 |
| Adipate ester w. $C_{10}$ alcohols | — | 5.0 | — |
| Phenolic antioxidant | 0.5 | 0.5 | 1.0 |
| Octylbutylphenylamine antioxidant | 0.5 | 0.5 | 1.0 |
| Alkenyl succinic acid half ester | 0.1 | 0.1 | 0.1 |
| Triazole derivative | 0.1 | 0.1 | 0.1 |
| | Test Results | | |
| Test | 3 | 4 | 5 |
| Viscosity, cSt @ 40° C. | 32.7 | 36.6 | 32.6 |
| Viscosity, cSt @ 100° C. | 6.06 | 6.62 | 6.0 |
| Viscosity Index | 134 | 138 | 133 |
| Rotary Bomb Oxidation Test, Min. | 600+ | 600+ | 1000+ |
| PDSC Onset Temp., °C. | 226 | 227 | 232 |
| PDSC Onset Time @ 180° C., Min. | 18 | 21 | 28 |
| SSW Rust Test | Pass | Pass | Pass |
| Copper Strip Corrosion | 1A | 1B | 1B |
| 4-Ball Wear | 0.48 | 0.44 | 0.46 |
| Load Wear Index | 22 | 18 | 18 |
| Weld Point, kg | 126 | 126 | 126 |

TABLE OF MATERIALS

| | | |
|---|---|---|
| Vanlube 848 | Octylbutylphenylamine | R. T. Vanderbilt |
| IRGANOX ® L-130 | Phenolic antioxidant | Ciba-Giegy |
| Reocor 12 | Alkenyl succinic acid half ester | Ciba-Giegy |
| Reomet 39 | Triazole derivative | Ciba-Giegy |
| Mobil SHF-61 | 6 cst PAO | Mobil Chemical |
| Mobil SHF-82 | 8 cst PAO | Mobil Chemical |
| Mobil P-43 | TMP ester w. $C_8$-$C_{10}$ acids | Mobil Chemical |
| Mobil DB-31 | Adipate ester w. $C_{10}$ alcohols (Decyl adipate). | Mobil Chemical |
| Regal R&O 68 | Also ISO 68, premium grade oil formulated to meet the lubrication requirements of steam and gas turbines, hydraulic systems and air compressors. It is formulated with high quality solvent refined paraffin base stocks and contains a balanced rust and oxidation inhibitor package and an anti-foamant. | Texaco |

TABLE OF TEST METHODS

| | |
|---|---|
| 4-Ball Wear, wear scar diameter, mm. (54° C.; 1800 rpm, 20 kg.) | ASTM D-2266 |
| Copper Strip Corrosion | ASTM D-4048 |
| 4-Ball EP | ASTM D-2596 |
| Load Wear Index | ASTM D-2783 |
| Weld Point | ASTM D-2783 |
| SSW Rust Test | ASTM D-665B |
| Rotary Bomb Oxidation Test | ASTM D-2272 |
| PDSC Onset Temp., °C. | Extrapolated Oxidation Onset Temperature in Temperature Programmed Pressure Differential Scanning Calorimetry with a 10° C./min temperature increase in a 500 psig oxygen atmosphere. |
| PDSC Onset Time, Min. | Extrapolated Oxidation Onset Time in Isothermal Pressure Differential Scanning Calorimetry with a 180° C. Temperature (after a 40° C./min heat up) in a 500 psig oxygen atmosphere. |

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A compressor lubricating oil composition comprising:

a. a major portion of a base lubricating oil comprising a polyalphaolefin having a kinematic viscosity of 4 cSt to 10 cSt at 100° C.;

b. an additive composition solubilizing amount of at least 5 wt % of an ester oil selected from the group consisting of diesters and triesters;

c. said additive composition comprising:

i. 0.1 to 3 wt % of an antioxidant comprising a mixture of t-butyl phenolic antioxidant and octylbutylphenylamine, ii. 0.01 to 0.5 wt % of a rust inhibitor comprising a mixture of triazole and alkenyl succinic acid ester rust inhibitors in the absence of sulfur, phosphorous and metals.

2. The lubricating oil composition of claim 1 wherein the ester oil comprises 5 to 20 wt %.

3. The lubricating oil composition of claim 1 wherein the antioxidant comprises about 1 wt % to 2 wt %.

4. The lubricating oil of claim 1 wherein the rust inhibitor comprises about 0.1 to 0.2 wt %.

* * * * *